US005845445A

United States Patent [19]

Blackbeard

[11] Patent Number: 5,845,445

[45] Date of Patent: Dec. 8, 1998

[54] INSULATED CONCRETE FORM

[76] Inventor: Geoffrey J. Blackbeard, P.O. Box 1427, R. R. #1, Salisbury, New Brunswick, Canada, E0A 3E0

[21] Appl. No.: 763,978

[22] Filed: Dec. 10, 1996

[51] Int. Cl.[6] ..... E04B 2/00

[52] U.S. Cl. ..... 52/426; 52/562; 52/434

[58] Field of Search ..... 52/562, 309.8, 52/309.17, 426, 427, 434, 442; 49/191, 192, 216, 219.2, 38, 40, 44, 45, 47

[56] References Cited

U.S. PATENT DOCUMENTS

| | | | |
|---|---|---|---|
| 2,825,956 | 3/1958 | Shoemaker . | |
| 2,898,659 | 8/1959 | Shoemaker . | |
| 2,920,371 | 1/1960 | Shoemaker . | |
| 3,055,073 | 9/1962 | Van Helden . | |
| 3,055,076 | 9/1962 | Helden et al. . | |
| 3,167,840 | 2/1965 | Hoffman . | |
| 3,236,490 | 2/1966 | Lovgren . | |
| 3,730,476 | 5/1973 | Prichard | 52/246 X |
| 3,756,555 | 9/1973 | Doubleday et al. . | |
| 4,034,957 | 7/1977 | Cody . | |
| 4,223,501 | 9/1980 | DeLozier . | |
| 4,247,073 | 1/1981 | Vario . | |
| 4,373,314 | 2/1983 | Allan | 52/434 X |
| 4,393,635 | 7/1983 | Long . | |
| 4,473,984 | 10/1984 | Lopez | 52/434 X |
| 4,508,310 | 4/1985 | Schultz . | |
| 4,516,372 | 5/1985 | Grutsch . | |
| 4,702,053 | 10/1987 | Hibbard . | |
| 4,706,429 | 11/1987 | Young . | |
| 4,938,449 | 7/1990 | Boeshart . | |
| 4,972,646 | 11/1990 | Miller . | |
| 4,998,394 | 3/1991 | Holzapfel et al. | 52/434 X |
| 5,279,089 | 1/1994 | Gulur . | |
| 5,323,578 | 6/1994 | Chagnon et al. | 52/426 |

FOREIGN PATENT DOCUMENTS

| | | |
|---|---|---|
| 1205970 | 7/1986 | Canada . |
| 2032640 | 6/1992 | Canada . |
| 2140221 | 9/1995 | Canada . |

*Primary Examiner*—Lanna Mai
*Attorney, Agent, or Firm*—Mario D. Theriault

[57] ABSTRACT

An insulated concrete form for forming an insulated poured concrete wall, having an inside surface and an outside surface. The outside surface is held in a spaced-apart parallel relationship with the inside surface by a plurality of tie members attached perpendicularly to both the inside and outside surfaces. The inside surface is a single-sided conventional concrete formwork comprising a plurality of plywood boards having each a plurality of latch members for respectively engaging with a first end of each of the tie members. The outside surface comprises a plurality of juxtaposed insulating foam panels and a plurality of elongated vertically aligned connecting members, having each an I-shaped portion respectively enclosing two adjacent edges of a bordering pair of the juxtaposed insulating panels. Each connecting member further has a tubular element with transversal slots and notches for enclosing and for respectively retaining, by means of a concrete nail in a central opening in the tubular element, a second end of each of the tie members and thereby, for retaining a pair of insulating panels in a forming-resistive manner in the spaced-apart parallel relationship with the plywood boards. When uncured concrete is poured into the form, the insulating panels remain in the spaced-apart parallel relationship with the plywood boards, and when the concrete is cured, the insulating panels remain bonded to the concrete wall.

17 Claims, 9 Drawing Sheets

INSULATED CONCRETE FORM

FIELD OF THE INVENTION

The present invention relates to a form for forming insulated poured concrete walls. More particularly, the present invention relates to a form having one side made of a plurality of juxtaposed polystyrene foam panels which remain permanently bonded to one surface of the concrete wall poured within this form.

BACKGROUND OF THE INVENTION

Insulating a concrete foundation wall is currently being done by one of several ways to minimize heat losses through the wall. A first conventional method comprises the steps of constructing a framework on the inside surface of the wall, and filling the voids in the frame with batt type insulation. Another conventional method is effected by manually applying insulating foam panels to the exterior surface of the wall and retaining the panels in place with adhesive and with the pressure of the backfill material.

The insulating foam panels may also be retained in place on the outside surface of a concrete wall by means of several T-shaped metal bars placed along the vertical joints between any two panels. Each T-bar is nailed through the panels and into the concrete wall. This particular method is described in Canadian Patent 1,205,970 issued on Jun. 17, 1986 to H. R. Wells and J. O. Beynon. According to this method, finishing materials such as gypsum drywall or exterior cladding materials may be affixed to the flanges of the T-bars with self tapping screws.

Another method for insulating a concrete wall is effected by pouring uncured concrete into a form made of a plurality of interconnecting foam blocks. Examples of these foam blocks are illustrated and described in U.S. Pat. No. 4,223,501 issued on Sep. 23, 1980 to H. K. DeLozier, and U.S. Pat. No. 4,706,429 issued on Nov. 17, 1987 to D. A. Young.

Each of these two patents describes a respective concrete form unit having a pair of rectangular sidewall members of the same size and shape which are held together in spaced relationship by rigid connecting members. In use, a number of these form units are mounted end to end in a course and one above the other in additional courses in interlocking relationship to provide a complete permanent wall form into which reinforcing steel bars are placed and concrete is then poured to form a continuous concrete reinforced wall. The form units remain in place to form part of the building or other structure, for insulating the reinforced wall from both sides.

A further method for insulating a concrete foundation wall is by incorporating into the wall a planar foam core which normally runs along a central region of that wall. The wall thus formed is a composite wall structure having a pair of outer poured concrete layers which are separated by a high density foam insulating layer and a plurality of tie members for holding the concrete layers against the insulating layer.

This later method is illustrated and described in U.S. Pat. No. 4,393,635 issued on Jul. 19, 1983 to R. T. Long, and also in U.S. Pat. No. 4,702,053 issued on Oct. 27, 1987 to D. B. Hibbard.

The firstly described methods for applying an insulated layer on a concrete wall after the wall is hardened and de-formed, may sometimes be labour intensive. These methods require the work of a first team of tradespeople to erect the form, to pour the concrete wall and to de-form the wall. A second team of workers is then required to install the insulation panels. In a period where competitiveness and efficiency expectations are high on the construction industry, these methods may not always provide a practical solution.

Similarly, the later described methods for installing insulation in situ a concrete wall, either by poring uncured concrete into foam blocks, or by incorporating a foam core in a concrete wall may not always be appropriate for meeting modern energy conservation practices. In this regard, one disadvantage of insulating a concrete foundation wall from the inside in a residential building for example, is that condensation tends to occur during cold periods between the insulation layer and the cold concrete surface. This condensation often causes high humidity levels in the basement and deteriorates wood and steel structures adjoining the concrete wall.

Another disadvantage of insulating a concrete wall from both sides of the wall, or with a central foam core is that the insulation tends to inhibit the effects of a phenomenon known as the thermal inertia of a concrete wall. This phenomenon is commonly referred to as Thermal Mass Effect.

Concrete has the ability to absorb and store significant amounts of heat. When a wall is insulated from the outside surface only, this heat is still inside the building insulation and it is available to reenter the space when the air temperature drops in this building. This is turn stabilizes the air temperature and minimizes temperature swings. Not only is the building more comfortable because of the stable temperature range, the demand on the heating system is cut dramatically creating greater efficiency of the system and improved energy consumption.

One method of the prior art for insulating a concrete wall from both sides, or from one side only, is disclosed in Canadian Patent Application 2,140,221 filed on Jan. 13, 1995 by K. I. Baxter. In this system, the insulating foam panels are retained inside a rigid concrete form having extended and modified flat tie members. Each foam panel is held inside two F-shaped strips straddling the vertical edges of the panel. The panels are retained in proper position on the inside surfaces of the concrete form so as to be on the inside and/or the outside surface of the poured wall. Then the concrete is poured into the forms and against the insulation. The concrete is cured and the form is later removed. The result is that the wall is already insulated to the extend desired. The F-shaped strips remain on the finished wall with the insulation panels, and are used as a base for attaching drywall screw fasteners for example.

It will be appreciated that the installation and fastening of an insulating layer inside a conventional concrete form, as described in the last aforesaid method, requires more work than installing the conventional form without the insulation. Furthermore, this method is limited to conventional concrete forms using flat tie members and wedges. Although the flat ties and wedges were very popular a few years back, the forming systems which are widely used nowadays use rod-like tie members having a round, square or polygonal cross-section.

One popular model of concrete formwork currently used by many contractors, is marketed by a Simplex Forms System Inc. of Rockford, Ill., U.S.A. This concrete forming system uses rod-like tie members. This concrete forming system is described in various patents including:

- U.S. Pat. No. 2,825,956, issued on Mar. 11, 1958 to J. C. Shoemaker;
- U.S. Pat. No. 2,898,659, issued on Aug. 11, 1959 to J. C. Shoemaker;
- U.S. Pat. No. 2,920,371, issued on Jan. 12, 1960 to J. C. Shoemaker;

U.S. Pat. No. 3,055,076, issued on Sep. 25, 1962 to W. L. Van Helden et al;

U.S. Pat. No. 3,167,840, issued on Feb. 2, 1965 to R. G. Hoffman;

U.S. Pat. No. 3,236,490, issued on Feb. 22, 1966 to E. C. Lovgren et al.;

The Simplex™ formwork is well known in the construction industry. It comprises plywood panels and which are held in a spaced apart relationship by tie members having embossed end portions. The forged end portions are made to engage with slotted levers to retain both sides of the formwork in a parallel relationship to one-another.

The methods of the prior art, and especially the described method of the prior art wherein a single insulating layer may be placed inside a conventional form, are not compatible to the Simplex™ concrete formwork as explained earlier. Therefore for those contractors having one or more sets of the popular formwork, and wanting to insulate the exterior surfaces of concrete walls, the investment for purchasing a new set of forms capable of holding foam panels therein is substantial. The additional work for placing the insulation panels inside those forms is also an additional burden having a negative effect on the productivity and competitiveness of these contractors.

SUMMARY OF THE INVENTION

In the present invention, however, there is provided an insulated concrete form for forming poured concrete walls, which is compatible to the popular conventional concrete formwork and which is particularly convenient for insulating only one surface of a concrete wall.

In one aspect of the present invention, the insulated concrete form has a first vertical surface and a second vertical surface. The second vertical surface is held in a spaced-apart parallel relationship with the first vertical surface, by a plurality of tie members attached to both the first and the second surfaces.

The first vertical surface is a single-sided conventional concrete formwork comprising a plurality of plywood boards having each a plurality of latch members for respectively engaging with a first end of each of the tie members. The second vertical surface comprises a plurality of juxtaposed insulation panels and a plurality of elongated vertically aligned connecting members, wherein each connecting member encloses a pair of adjacent edges on two juxtaposed insulation panels. Each connecting member has coupling means for retaining a second end of each of the tie members and for retaining the pair of insulation panels in a forming-resistive manner from the first surface.

A first advantage of the insulated concrete form of the present invention is that when concrete is poured and cured between the plywood boards and the insulation panels, the insulation panels remain permanently bonded to the concrete wall for subsequently insulating this concrete wall. Moreover, the insulation layer is preferably installed on an outside surface of the concrete wall for taking advantage of the thermal inertia of that wall.

In accordance to another aspect of the present invention, the connecting member has an I-shaped cross-section. This I-shaped cross-section comprises a first flange member aligned within an exterior plane of the insulation panels relative to the form, a second flange member aligned within an inside plane of the insulation panels relative to the form and a first web member aligned in a gap between the adjoining edges, for joining the first and the second flange members.

The first flange member has a nominal width, a nominal thickness and sufficient tensile strength for receiving and holding one or more screws threaded therein. Hence the first flange members of the connecting member of the present invention are advantageously usable for supporting wale members during the pouring and curing of concrete within the form, and later, for supporting building cladding materials.

It will be appreciated that the insulated concrete form of the present invention is easy to use and improves the overall productivity of a contractor erecting concrete foundations. It is known that the de-forming of a poured concrete wall usually requires the handling of the plywood boards upwardly out of an excavated basement and the scraping of these boards to remove concrete residues bonded thereto. Hence, the concrete form of the present invention uses only a single-sided conventional formwork whereby the total labour requirement for de-forming a wall and for handling and cleaning the boards is reduced in half as compared to the working of the double-sided formwork.

In accordance to a further aspect of the present invention, there is provided an insulated poured concrete wall having an inside surface, an outside surface and a plurality of tie members embedded perpendicularly between the inside and outside surfaces. The outside surface has a plurality of juxtaposed insulation panels bonded thereto, and a plurality of connecting members respectively enclosing a pair of adjoining edges of any two adjacent insulation panels. Each of these connecting members is made with a material having a low thermal conductivity, and has coupling means for retaining and for enclosing an end of each of the tie members near the outside surface of the wall. This coupling means is embedded in the concrete wall between the inside and outside surfaces of the wall, whereby the tie members are insulated from the outside air. Therefore, the insulated wall of the present invention does not loose heat through the tie members, and does not have condensation points on the inside surface thereof.

BRIEF DESCRIPTION OF THE DRAWINGS

The preferred embodiment of the invention will be further understood from the following description, with reference to the drawings in which.

DETAILED DESCRIPTION OF THE PREFERRED EMBODIMENT

Figure 1:
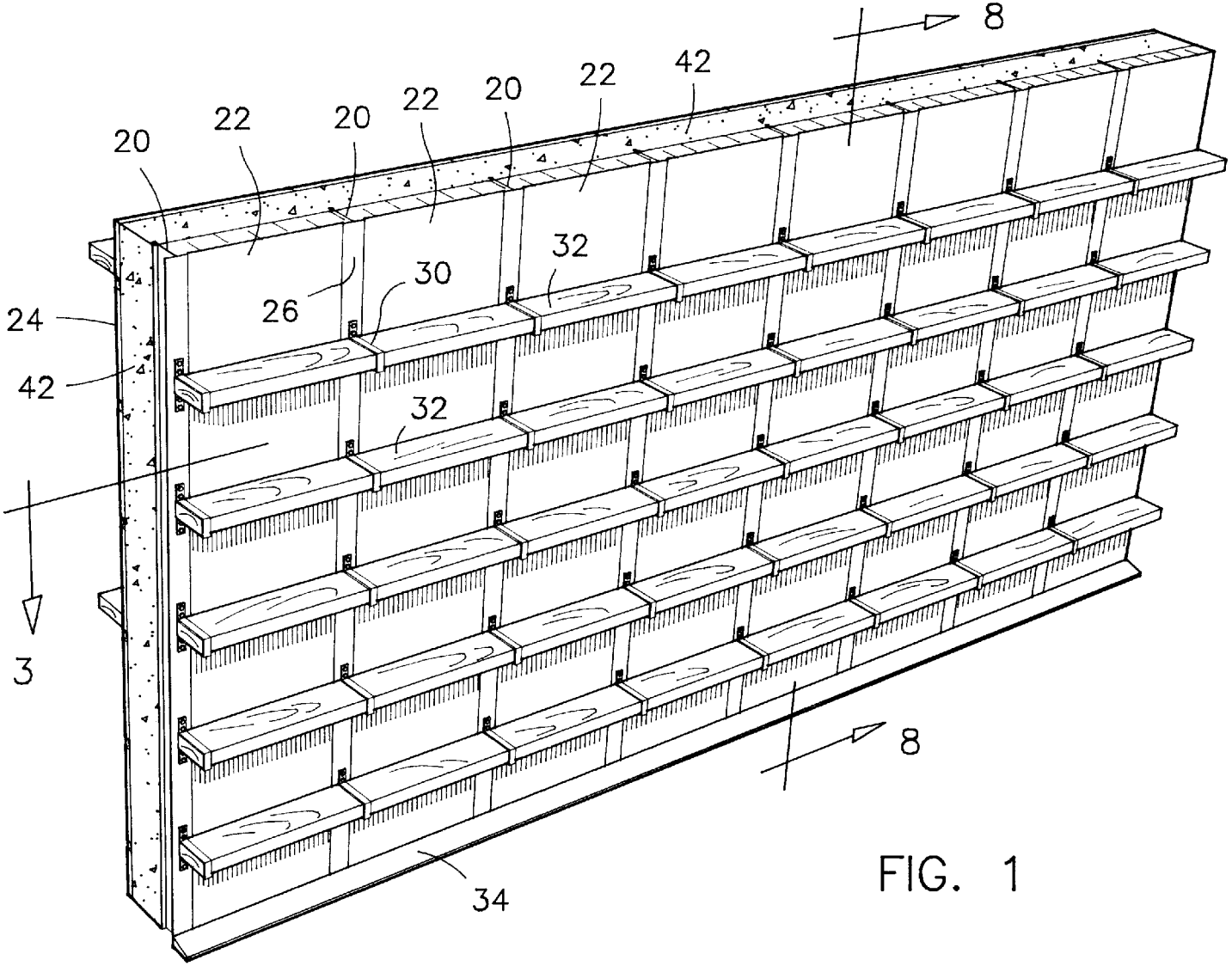
FIG. 1 is an outside, top and left end perspective view of a portion of an insulated concrete form of the preferred embodiment.
Figure 2:
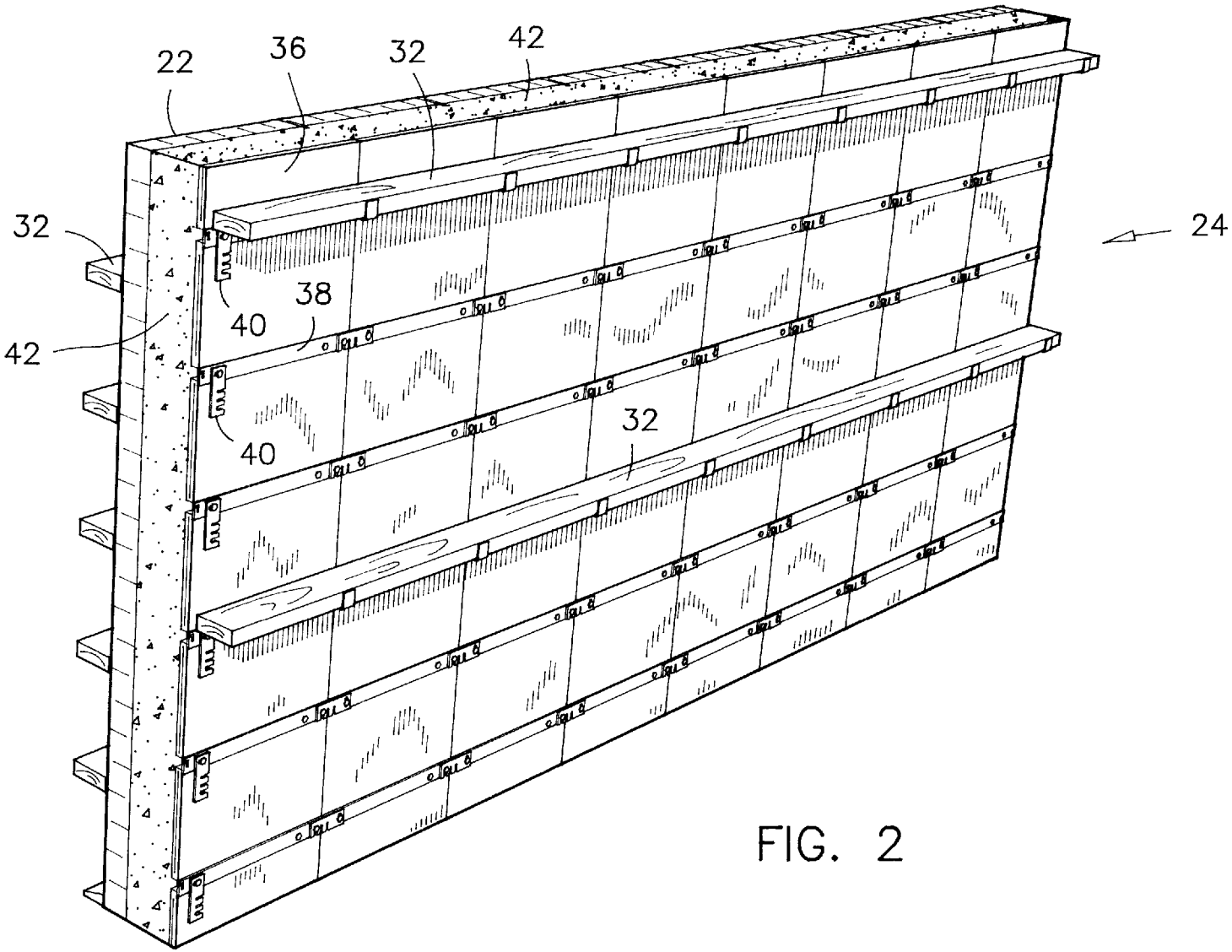
FIG. 2 is an inside, top and right end perspective view of the portion of the insulated concrete form of FIG. 1.

The insulated concrete form of the preferred embodiment is illustrated in its generality in FIGS. 1 and 2. The insulated concrete form of the preferred embodiment consists principally of an array of vertically aligned connecting members 20, joining a plurality of juxtaposed insulation panels 22 and retaining these panels 22 at a distance from a single-sided conventional concrete formwork 24.

Each connecting member 20 is preferably made of extruded PVC or similar plastic material having a low thermal conductivity. The connecting member 20 has an outer flange 26 overlapping the exterior surface of the insulation panels 22 and closing a gap between any two panels 22. When required, wales support brackets 30 are preferably attached to the connecting members 20 with screws threaded through these outer flanges 26.

In the illustrations of FIGS. 1 and 2, the exemplified portion of a concrete wall has a total height of about eight feet. An insulated concrete form having such height is preferably framed with five wale members 32, wherein the lowermost one is set at sixteen inches from the bottom of the wall, and the other wales are spaced vertically at sixteen inches apart.

It is also suggested to install along the lower edge of the insulation panels 22, a longitudinal shoe member 34 which is attached to the footing of the concrete wall.

The insulation panels 22 used in the insulated concrete form of the preferred embodiment are preferably extruded polystyrene foam panels, having each a thickness of about four inches, an overall width of slightly under twenty-four inches, and a length of eight feet. It will be appreciated that these dimensions are required when the single-sided conventional formwork 24 has the common two by eight foot plywood boards.

Accordingly, the conventional single-sided concrete formwork 24 used with the insulated concrete form of the preferred embodiment is preferably a type similar to the Simplex™ formwork using plywood boards 36, having reinforcing horizontal steel flat bars 38 at various location there across and slotted latch clips 40 mounted on each flat bars 38, and adapted to latch onto conventionally embossed rod-like tie bars having a round, oval, square or polygonal cross-section. The conventional single-sided concrete formwork 24 is also preferably installed with one or more wale members 32 as illustrated in FIG. 2.

As it will be explained later, the connecting members 20 are sufficiently strong to resist the pressure applied inside the form by the uncured concrete being poured into the form. The connecting members 20 and insulation panels 22 become an integral part of the form, and a plywood structure is not required to support the insulated side of the form.

Once concrete is cured between the insulation panels 22 and the plywood boards 36, the insulation panels 22 remain bonded to the concrete wall. The PVC connecting members 20 become partially embedded in the concrete wall for further retaining the insulation panels 22 in a permanent manner against the surface of the concrete wall. The outer flanges 26 on the connection members 20 are thereby useful for fastening facade materials such as siding, brick and stucco to the building.

In addition to the aforesaid advantages of insulating a foundation wall from the outside for taking advantage of the thermal mass of the foundation wall, the foam layer protects the concrete from backfilling stresses and because of its resiliency, it also protects the foundation from frost pressure created from freezing moisture that may be trapped in the soil. It will also be appreciated that because the concrete remains relatively warm, condensation on the inside surface of the wall is nonexistent.

Figure 3:
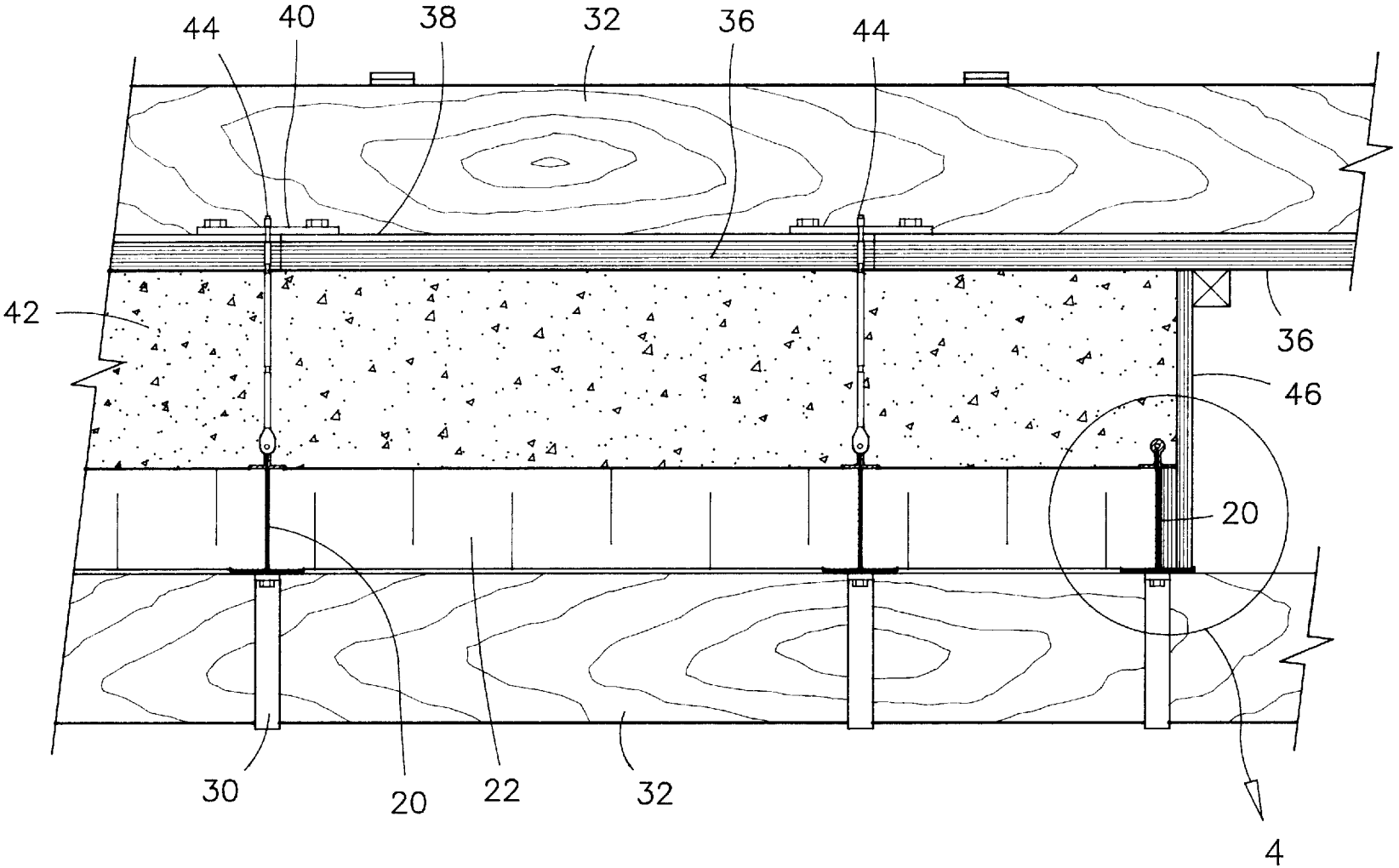
FIG. 3 is a horizontal cross-section view of the insulated concrete form of the preferred embodiment, along line 3 in FIG. 1.
Figure 6:
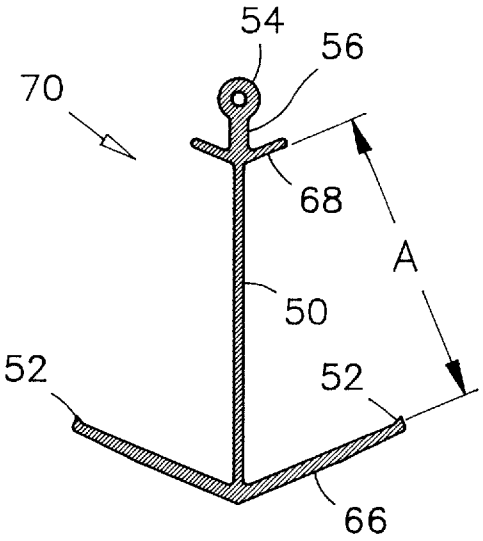
FIG. 6 is a cross-section view of a third connection member which is used to connect two adjacent insulation panels forming an obtuse corner in a concrete wall.
Figure 4:
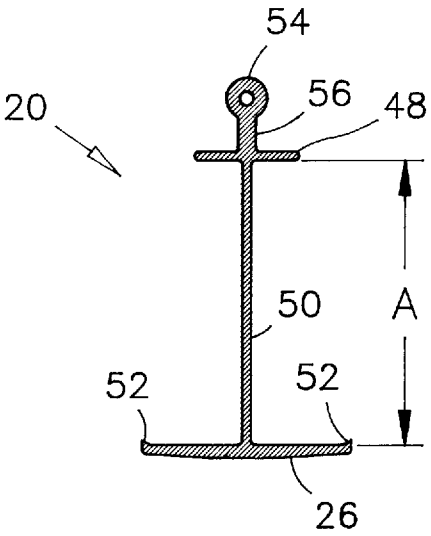
FIG. 4 is enlarged view of Detail 4 in FIG. 3. The cross-section illustrated therein is from a connecting member which is used to connect adjacent insulation panels along a straight wall.

Referring now to FIGS. 3 and 4, the insulating foam panels 22 are held in a spaced-apart relationship with the plywood boards 36 of the single-sided conventional formwork 24, by means of tie members 44 between the connecting members 20 and the latch clips 40, much like a usual installation of the tie rods in a conventional concrete formwork. Each tie member 44 has a conventional embossed end to engaged into the latch clip 40, and a flattened holed end for engaging into the connecting member 20, as will be explained later when making reference particularly to FIG. 7.

There is also illustrated in FIG. 3, a suggested method for framing a vertical edge on a concrete wall. The vertical edge is framed with a plywood panel 46 extending the full height of the wall. This plywood panel 46 is preferably nailed to a connecting member 20 along a first edge thereof and to the plywood form 36 along its other edge.

The connection member 20 has an I-shaped conformation comprising the outer flange 26, an inner flange 48 parallel to the outer flange 26 and separated from the outer flange 26 by a first web member 50. The distance "A" between the outer flange 26 and the inner flange 48 is substantially the same as the thickness of an insulation panel 22.

The outer flange 26 of the connecting member 20 of the preferred embodiment has a ridge 52 along both sides of the flange 26, and facing the inner flange 48. The height of these ridges 52 reduces the dimension "A" along both edges of flange 26 such that the fit of the connection member 20 over the edge of an insulation panel 22 is a light interference fit. Therefore, during installation of the insulation panels 22 and the connecting members 20, the panels are positively secured in place within the connecting members 20.

The connection member 20 further has an elongated tubular element 54 running along and parallel to the inner flange 48. The tubular element 54 is spaced from the inner flange 48 by a second web member 56 having a nominal width and thickness. This tubular element 54 is transversally slotted and notched at intervals for receiving the flattened holed ends of tie rods 44 as will be explained later.

Figure 5:
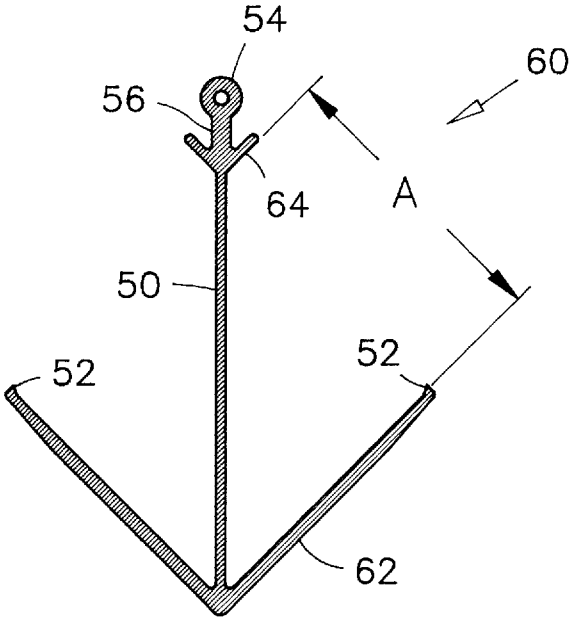
FIG. 5 illustrates a cross-section view of a second connecting member which is used to connect two adjacent insulation panels forming a right angle corner in a concrete wall.

The connection member 20 may be formed into numerous configurations for retaining foam panels 22 around corners in a concrete wall for example. In this respect, FIG. 5 illustrates a connecting member 60 for forming right angle corners in a foundation wall. The outer flange 62 and the inner flange 64 of this connecting member 60 define respectively a right angle shape.

Figure 7:
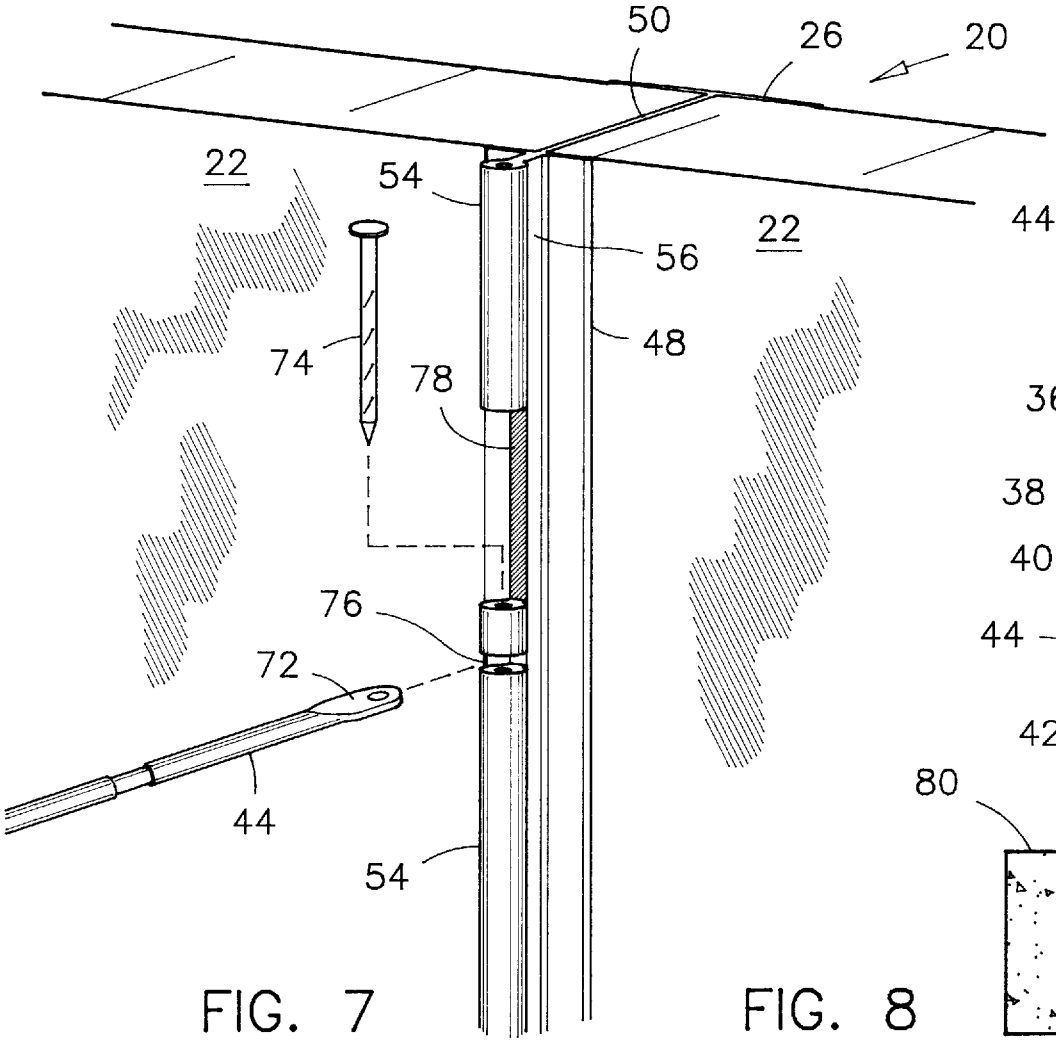
FIG. 7 is an oblique view of a connection member illustrating a milled slot and indention for receiving and connecting a tie member.

Similarly, the outer flange 66 and inner flange 68 of connecting member 70 illustrated in FIG. 7, define respectively an obtuse shape for forming obtuse corners in a foundation wall.

Figure 8:
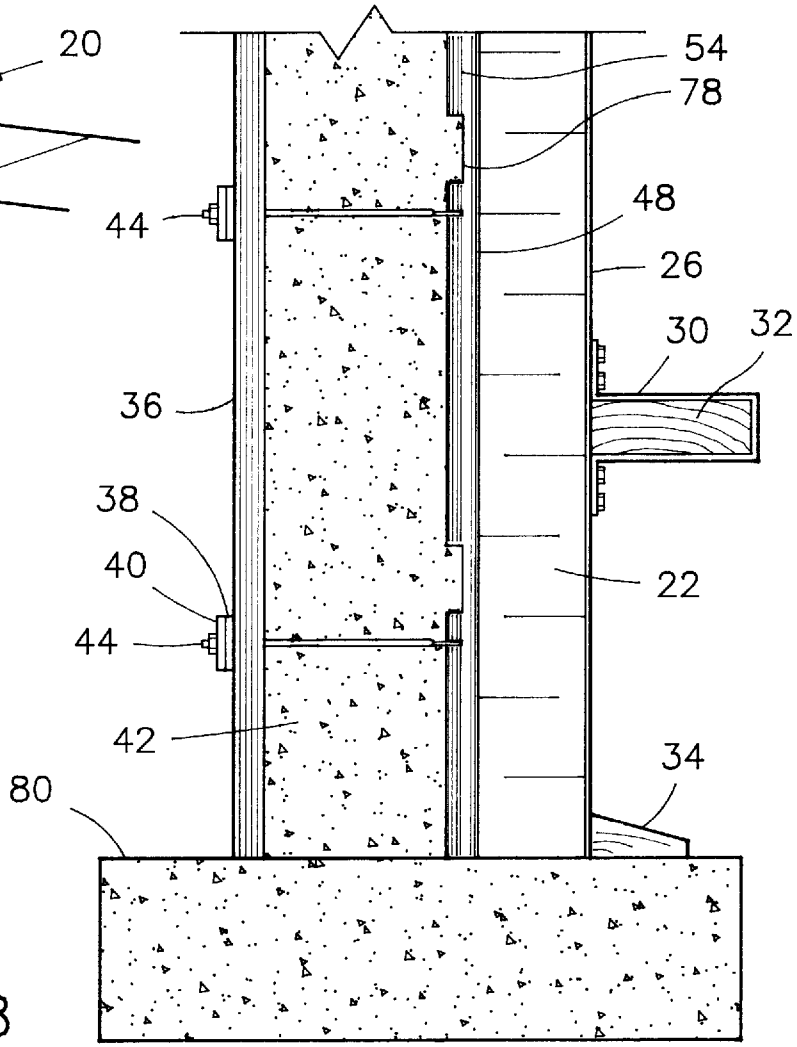
FIG. 8 is a partial cross-section view of the insulated concrete form of preferred embodiment along line 8—8 in FIG. 1.

Referring now to FIGS. 7 and 8, there is illustrated therein the preferred method for retaining the foam panels 22 at a distance from the plywood boards 36 of a conventional concrete formwork. Each tie rod 44 of the conventional formwork is cut at a prescribed length. The cut end 72 is flattened and drilled to receive a nail 74. The tubular element 54 is machined to generate transversal slots 76 therein at spaced intervals. Notches are also machined at intervals in the tubular element 54, with each notch 78 being at close proximity from each slot 76.

The spacing between any two adjacent slots 76 corresponds to the normal spacing between two adjacent slots and latch clips 40 on the conventional formwork. Hence, a same number of tie members 44 is installed in the insulated concrete form of the preferred embodiment, as the usual number of tie members installed in the conventional formwork. Sufficient strength is found in the connection member 20 for retaining a set of tie rods 44 when this connection member is made with PVC material and a thickness of the web members 50, 56, of a central portion of both flanges 26, 48 and of a wall of the tubular element 54 is about ⅛ inch.

The width of each slot 76 is slightly larger than the thickness of the flattened end 72 such that when the flattened end 72 is inserted in the slot 76, the tie member 44 has a minimum movement relative to the longitudinal axis of the connecting member 20.

In use, the connecting member 20 is oriented with a notch 78 above each slot 76. The length of each notch 78 is preferably slightly longer than nail 74, such that the nail 74 is easily insertable thereinto and in the hollow core of the tubular element 54, to lock the flattened end 72 of the tie member 44 in the slot 76. The nails 74 used with the insulated concrete form of the preferred embodiment are preferably nominal three-inch concrete nails. Although numerous similar elongated objects may serve the same purpose, it has been found that the dimension and tensile strength of a three-inch concrete nail is convenient for this application.

The installation of the insulated concrete form of the preferred embodiment is effected by firstly installing and securing a first plywood board 36 of the conventional formwork 24. A connecting member 20 is then installed at a distance from the plywood board 36, and tied to the plywood board 36 with a first series of tie members 44. Once the connecting member 20 is held in place to the plywood board 36, a foam panel 22 is inserting between the flanges 26, 48 of the connecting member 20. A next and subsequent plywood board 36 is thereafter installed to joint the first board 36. A second and subsequent connecting member 20 and foam panels 22 are similarly installed in alignment with the first foam panel 22, thereby forming a wall of foam insulation spaced apart from the conventional single-sided plywood formwork.

Once the insulated concrete form is erected, wale members 32 are installed as appropriate, and a foot member 34 is preferably secured to the footing 80 as mentioned earlier. The uncured concrete is then poured inside the form, directly against the foam panels 22.

The tubular element 54 of each connecting member 20 becomes embedded into the concrete. Because the second web member 56 is slightly thinner in cross-section than the tubular element 54, the connecting member 20 becomes positively anchored to the concrete wall. This has the advantage of preventing a possible separation of the foam insulation from the surface of the wall as the foam panels and concrete deteriorate from weather exposure and aging. The positive anchoring of the connecting member 20 to the concrete wall also provides a rigid support for retaining cladding materials to the outer flange 26.

This method of connecting the tie rods 44 into the tubular element 54 provides an additional advantage of reducing heat losses through the rods 44 when these rods are made of steel for example. The tie rods 44 in the insulated concrete form of the preferred embodiment do not traverse the concrete wall completely. Hence, the tie rods 44 do not make path for heat sink, and corresponding point of condensation on the inside surface of a foundation wall, as it is customary with tie rods of the prior art spanning through the entire thickness of a concrete wall.

Figure 9:
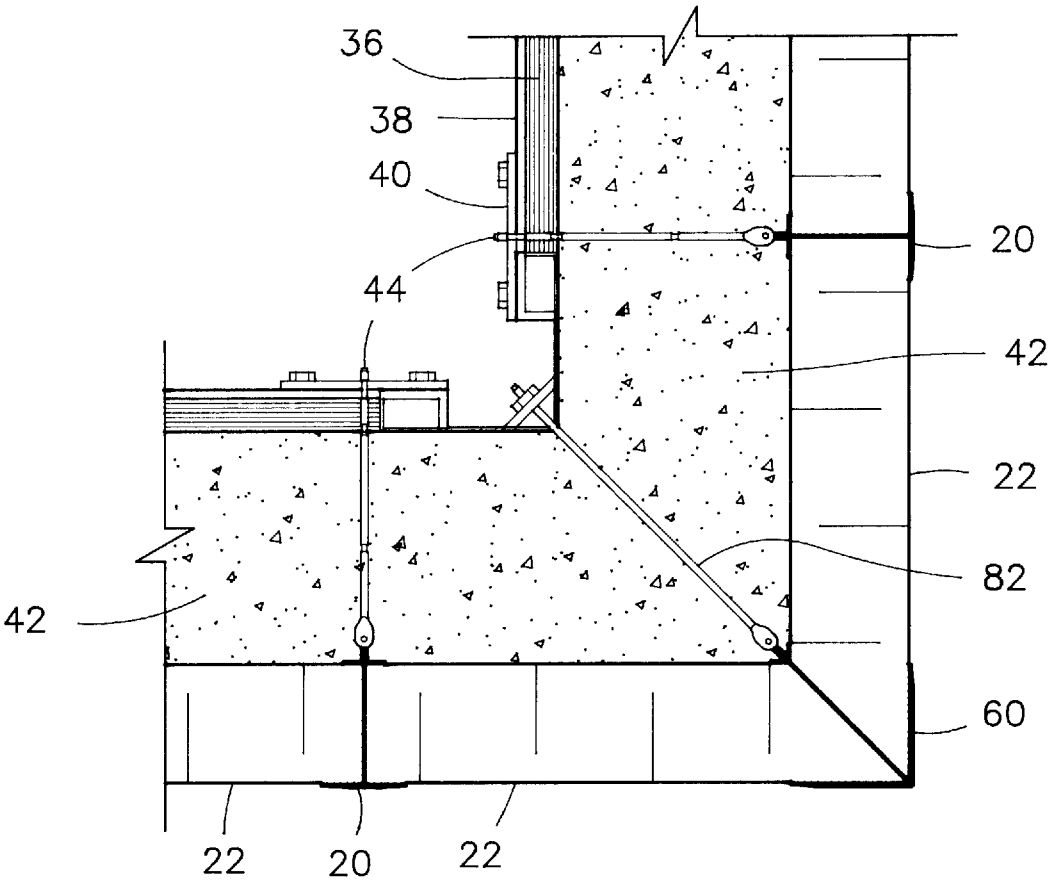
FIG. 9 is a horizontal cross-section view of the concrete form of the preferred embodiment forming an outside right angle corner.
Figure 11:
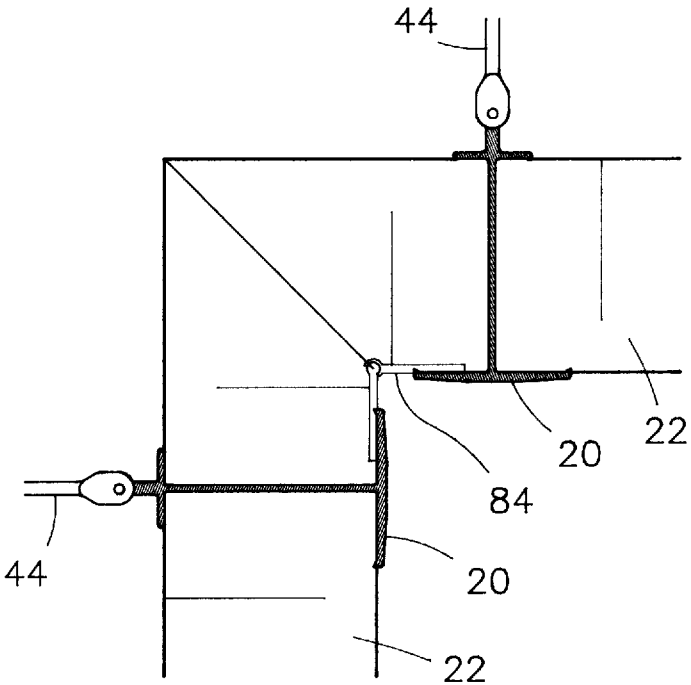
FIG. 11 is an enlarged view of Detail 11 in FIG. 10.
Figure 10:
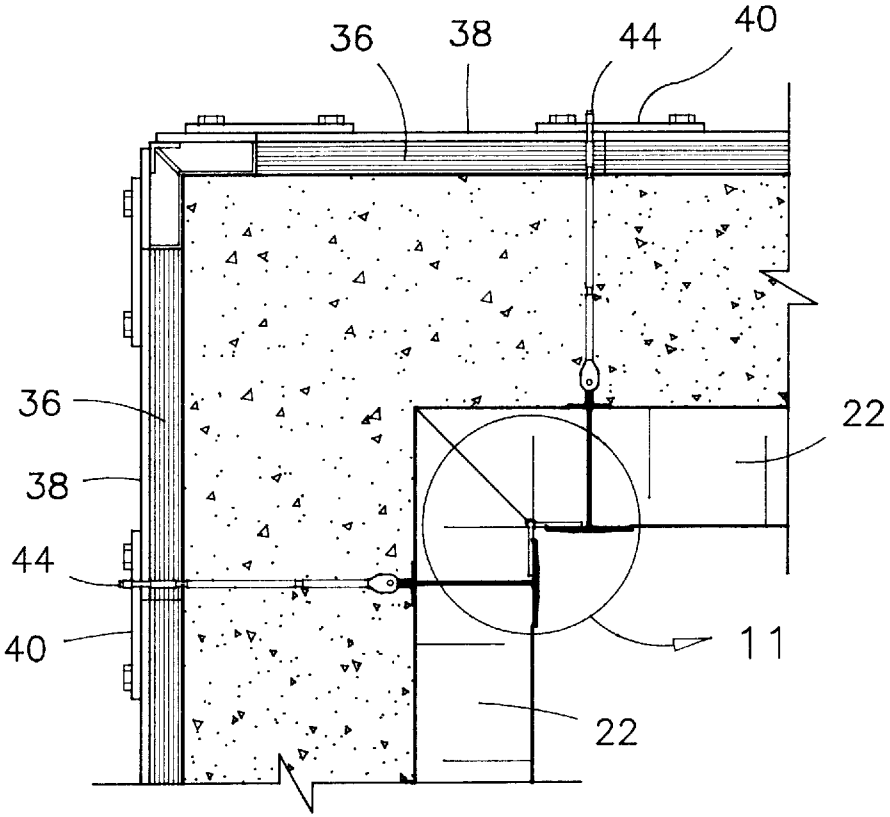
FIG. 10 is a horizontal cross-section view of the insulated concrete form of preferred embodiment forming an inside right angle corner.
Figure 12:
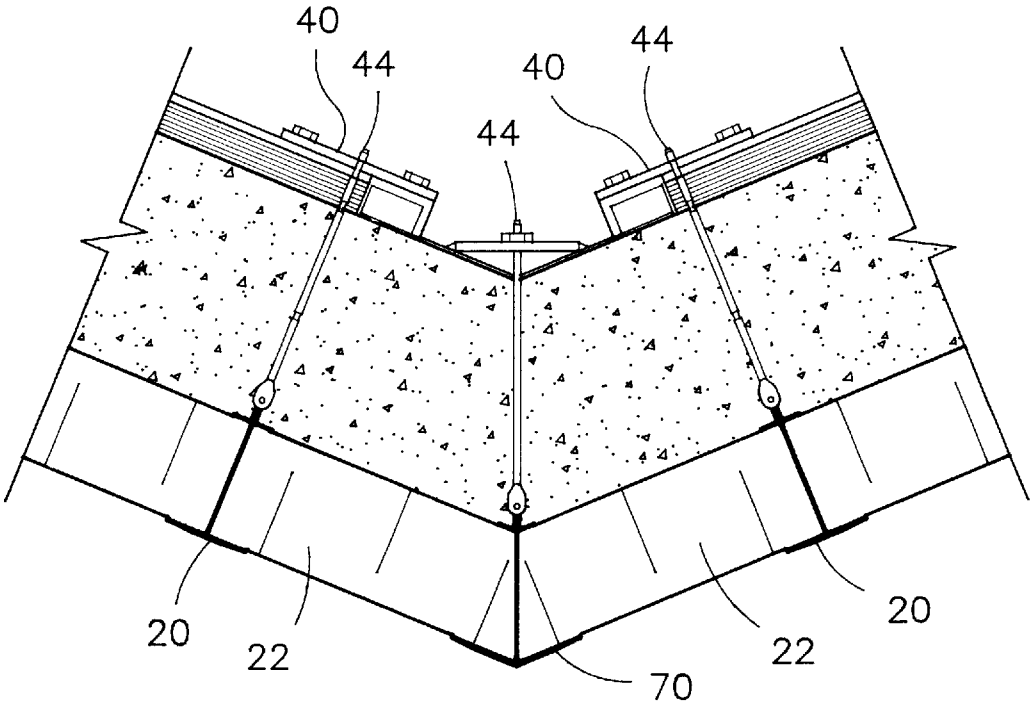
FIG. 12 is a horizontal cross-section view of the insulated concrete form of the preferred embodiment forming an outside obtuse corner.
Figure 14:
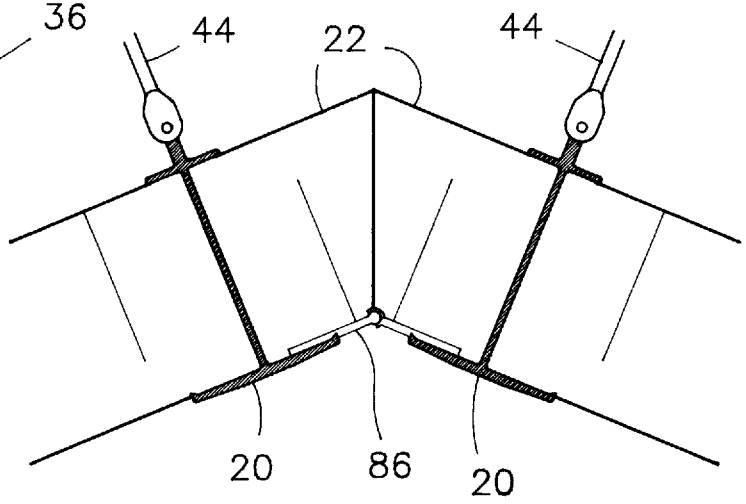
FIG. 14 is an enlarged view of Detail 14 in FIG. 13.
Figure 13:
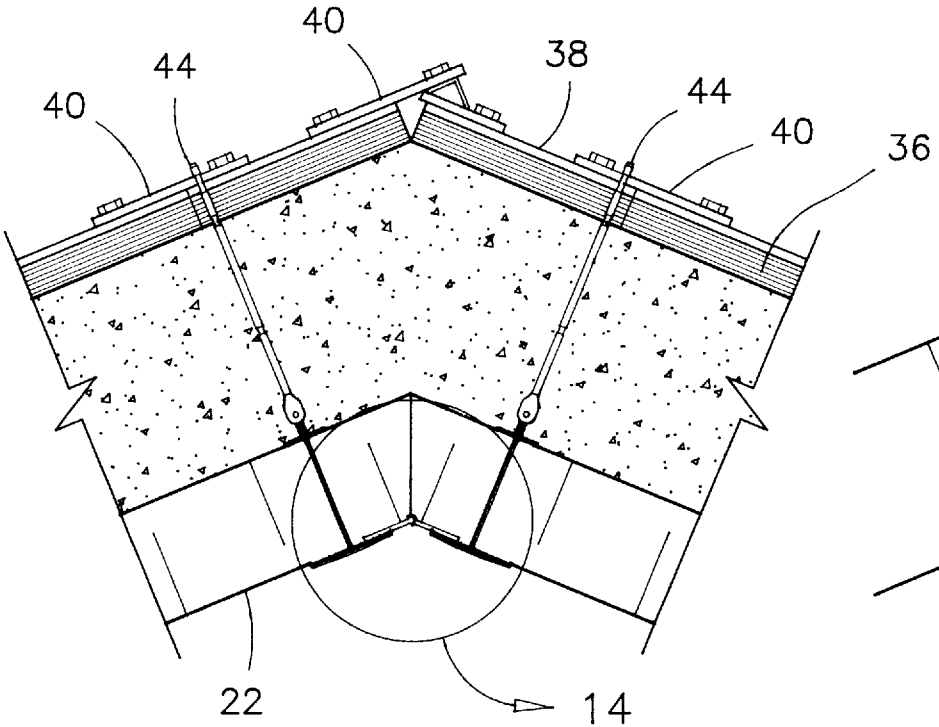
FIG. 13 is a horizontal cross-section view of the insulated concrete form of the preferred embodiment forming an inside obtuse corner.

Referring now to FIGS. 9 to 14, there are illustrated therein several types of corners in an insulated poured concrete foundation wall. An outside right angle corner as illustrated in FIG. 9 is preferably framed with a right angle connecting member 60. The connecting member 60 is preferably held to the single-sided conventional formwork by tie rods 82 which are evidently longer than the tie members 44.

An inside right angle corner in the insulated concrete form of the preferred embodiment is preferably framed with two standard connecting members 20 installed at right angle, and at close proximity from one-another. A gap between these two connecting members 20 is preferably entirely or partially closed by two or more hinges 84 attached to the flanges 26, or by a structural steel angle (not shown).

Similarly, an outside obtuse corner in the insulated concrete form of the preferred embodiment is framed with the obtuse connecting member 70. An inside obtuse corner is also framed with two standard connecting members 20. The gap between the two standard connecting members 20 on the inside obtuse corner is also closed by one or more hinges 86 or a flat bar (not shown) which is bent to fit the angle of that corner.

Once the concrete inside the insulated form of the preferred embodiment has hardened and cured, the de-forming of the concrete wall is limited to the removal of the plywood boards 36 from the inside surface of the wall. This method represents a substantial labour cost saving as compared to a double-sided conventional formwork. As it was explained earlier, only half of the normal amount of plywood boards 36 are used and handled. The insulated surface of the wall does not require any additional work except for the removing of the wale members 32 if those members were used.

Therefore, the insulated concrete forming system of the preferred embodiment is efficient, easy to work with, and compatible with the popular conventional concrete formwork. The insulated concrete form of the preferred embodiment is an attractive system for use in a period where the construction industry is under continuous stresses for increasing their efficiency and for meeting the modern regulations for energy conservation in buildings.

While the above description provides a full and complete disclosure of the preferred embodiment of this invention, various modifications, alternate constructions and equivalents may be employed without departing from the true spirit and scope of the invention. Such changes might involve alternate materials, components, structural arrangements, sizes, construction features or the like. Therefore, the above description and the illustrations should not be construed as limiting the scope of the invention which is defined by the appended claims.

I claim:

1. An insulated concrete form for forming a poured concrete wall, said form having a first vertical surface and a second vertical surface held in a spaced-apart parallel relationship with said first vertical surface by a plurality of elongated tie members attached perpendicularly to both said first and said second surfaces;

said first vertical surface is a single-sided concrete formwork comprising a plurality of plywood boards having each a plurality of latch members for respectively engaging with a first end of each of said tie members;

said second vertical surface comprising a plurality of juxtaposed insulation panels and a plurality of elongated vertically aligned connecting members having flange means respectively enclosing two adjacent edges of a bordering pair of said juxtaposed insulation panels;

said flange means having an I-shaped cross-section having a first flange member aligned along an exterior surface of said insulation panels relative to said form a second flange member aligned on the inside surface of said insulation panels relative to said form, and a first web member aligned into a gap between said two adjacent edges for perpendicularly joining said first and said second flange members;

said connecting members further having coupling means for retaining a second end of each of said tie members and for retaining said insulation panels in a forming-resistive manner in said spaced-apart parallel relationship with said plywood boards; said coupling means being held to and spaced apart from said second flange member by a second web member, and said second web member being narrower in cross-section than a corresponding cross-section of said coupling means;

whereby when uncured concrete is poured thereinto, said insulation panels remain in said spaced-apart parallel relationship with said plywood boards, and when said concrete is cured, said insulation panels remain bonded to said concrete wall with said coupling means being enclosed in said concrete wall.

2. An insulated concrete form as claimed in claim 1 wherein each of said tie members is a rod-type tie member, with said first end being embossed and said second end being flattened and holed.

3. An insulated concrete form as claimed in claim 2, wherein said coupling means encloses said second ends of said tie members; whereby when said uncured concrete is poured thereinto, said second ends of said tie members are embedded in said concrete wall.

4. An insulated concrete form as claimed in claim 3 wherein said connecting member is made of a plastic material having a low thermal conductivity.

5. An insulated concrete form as claimed in claim 4 wherein said connecting member is made with PVC material, and a thickness of said first flange is about ⅛ inch.

6. An insulated concrete form as claimed in claim 4 wherein said connecting member is made of polyvinyl chloride.

7. An insulated concrete form as claimed in claim 1 wherein said insulation panel has a thickness of about four inches.

8. An insulated concrete form as claimed in claim 7 wherein said insulation panel is made of extruded polystyrene foam.

9. An insulated concrete form as claimed in claim 1 wherein said coupling means is a tubular element oriented along said second flange member, and said tubular element has a plurality of transversal slots for respectively receiving said flattened and holed end therein with a hole in said flattened and holed end in axial alignment with a central opening of said tubular member, and a plurality of notches with each of said notches being near one of said transversal slots for inserting a nail therein, in said central opening and through said flattened and holed end when said flattened and holed end is engaged in said one of said transversal slots.

10. An insulated concrete form as claimed in claim 9 wherein said nail is a three-inch concrete nail, and a length of said notch is about three inches.

11. An insulated concrete form as claimed in claim 1, wherein a cross-section of said first flange member defines a right angle whereby said connecting member is usable for shaping a right angle corner in said form.

12. An insulated concrete form as claimed in claim 1 wherein a cross-section of said first flange member defines an obtuse angle whereby said connecting member is usable for shaping an obtuse corner in said form.

13. An insulated concrete form for forming a poured concrete wall, said form having a first vertical surface and a second vertical surface held in a spaced apart parallel relationship with said first vertical surface by a plurality of elongated tie members attached perpendicularly to both said first and said second surfaces;

said first vertical surface is a single-sided concrete formwork comprising a plurality of plywood boards having each a plurality of latch members for respectively engaging with a first end of each of said tie members;

said second vertical surface comprising a plurality of juxtaposed insulation panels and a plurality of elongated vertically aligned connecting members;

each of said connecting members having an I-shaped cross-section, comprising a first flange member aligned along an exterior surface of said insulation panels relative to said form, a second flange member aligned along an inside surface of said insulation panels relative to said form, and a first web member aligned in a gap between said two adjacent edges for perpendicularly joining said first and said second flange member, whereby said I-shaped cross-section respectively encloses two adjacent edges of a bordering pair of said juxtaposed insulation panels;

said connecting member further having coupling means for retaining a second end of each of said tie members and for retaining said insulation panels in a forming-resistive manner in said spaced-apart parallel relationship with said first surface;

whereby when uncured concrete is poured thereinto, and said concrete is later cured, said insulation panels remain bonded to said concrete wall and said first flange member is usable for attaching cladding material thereto.

14. An insulated concrete wall as claimed in claim 13 wherein said coupling means is mounted between said insulation panels and said single-sided formwork, and encloses said second ends of said tie members, whereby when said uncured concrete is poured thereinto, said second ends of said tie members are embedded in said concrete wall.

15. An insulated concrete form as claimed in claim 13 wherein said first flange member is spaced apart from said second flange member a distance corresponding to a thickness of said insulation panels, and said first flange member has ridges protruding toward said second flange member for retaining said insulation panels in a restrictive manner.

16. An insulated concrete form as claimed in claim 13 wherein said connecting member is made of a plastic material having a low thermal conductivity.

17. An insulated concrete form as claimed in claim 16 wherein said plastic material is PVC material, and a thickness of said first flange is about ⅛ inch.

* * * * *